US005163596A

United States Patent [19]

Ravoo et al.

[11] Patent Number: 5,163,596

[45] Date of Patent: Nov. 17, 1992

[54] PORTABLE PNEUMATIC TOOL EMPLOYING IMPROVED MAGAZINE FEED, EJECT AND JAM-CLEARING TECHNIQUE

[75] Inventors: Antonie H. Ravoo, Orlando; Keith F. Bullinger, Oviedo, both of Fla.

[73] Assignee: Fastech, Inc., Orlando, Fla.

[21] Appl. No.: 610,557

[22] Filed: Nov. 8, 1990

[51] Int. Cl.[5] ..... B25C 5/06

[52] U.S. Cl. ..... 227/109; 227/120; 227/123

[58] Field of Search ..... 227/109, 120, 123, 127, 227/135, 139, 114, 125

[56] References Cited

U.S. PATENT DOCUMENTS

| | | | |
|---|---|---|---|
| 3,174,672 | 3/1965 | Juilfs | 227/120 |
| 3,554,428 | 1/1971 | Smith | 227/109 |
| 4,688,710 | 8/1987 | Massari, Jr. et al. | 227/123 |

*Primary Examiner*—Douglas D. Watts
*Assistant Examiner*—Allan M. Schrock
*Attorney, Agent, or Firm*—Allen, Dyer, Doppelt, Franjola & Milbrath

[57] ABSTRACT

A pneumatic tool is provided with a magazine having an open feed end extending into the fastener's guide body, with a sacrificial anvil attached at the open feed end and easily removable when required because of wear. The fastener magazine also includes removable and adjustable side rails for adjusting the dimension to accommodate fasteners of different sizes. The fastener is provided with a feeder shoe having a pivotal finger which permits fasteners to be easily loaded underneath the feeder shoe and then drawn rearwardly to urge the fasteners across the open feed end of the magazine. The tool includes a pivotal front plate having a spring mechanism for reducing the risk of injury when the front plate opens as a result of a fastener jam.

28 Claims, 4 Drawing Sheets

FIG. 1
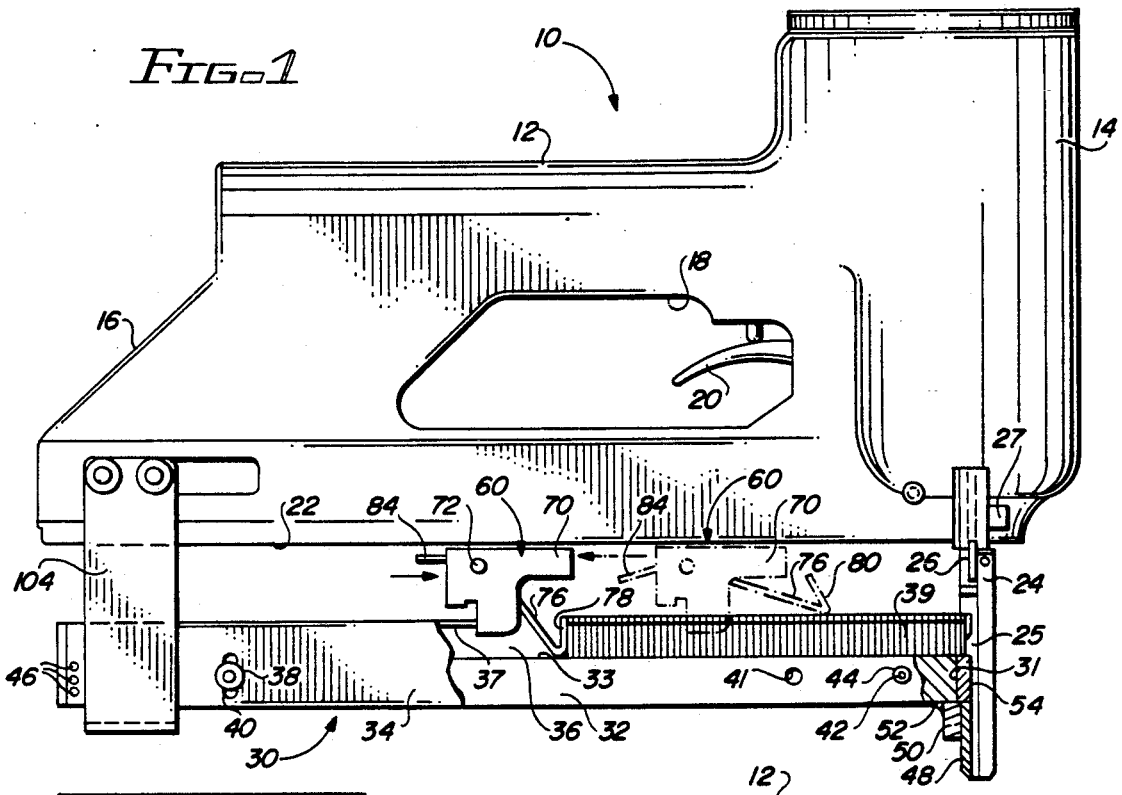
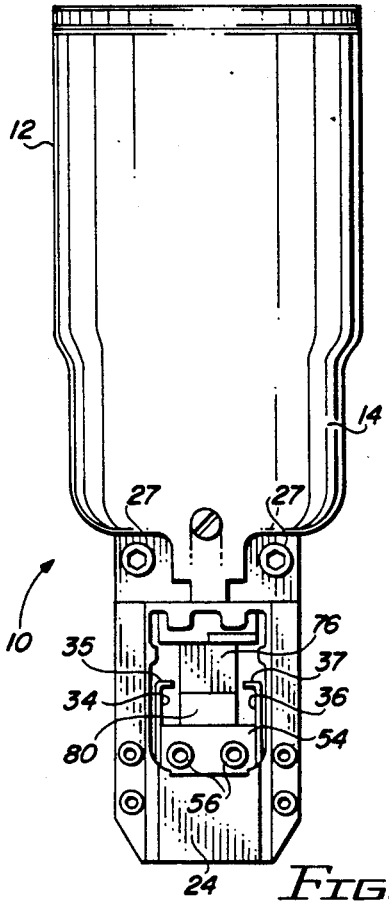
FIG. 2
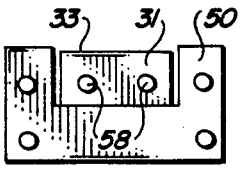
FIG. 4c
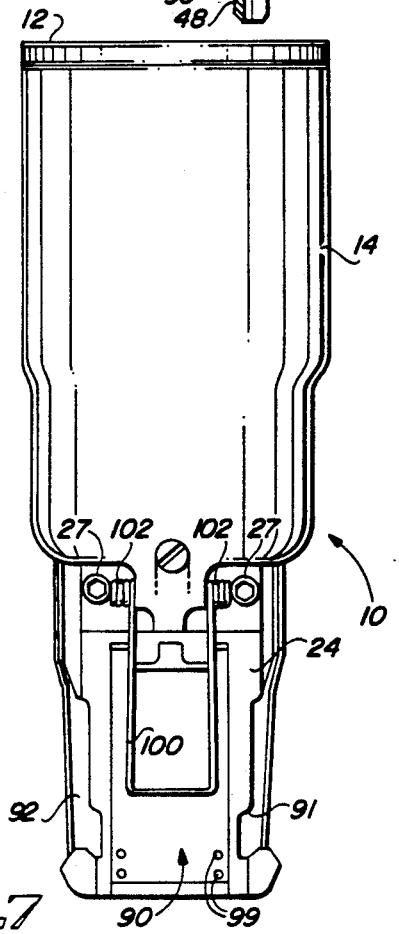
FIG. 7

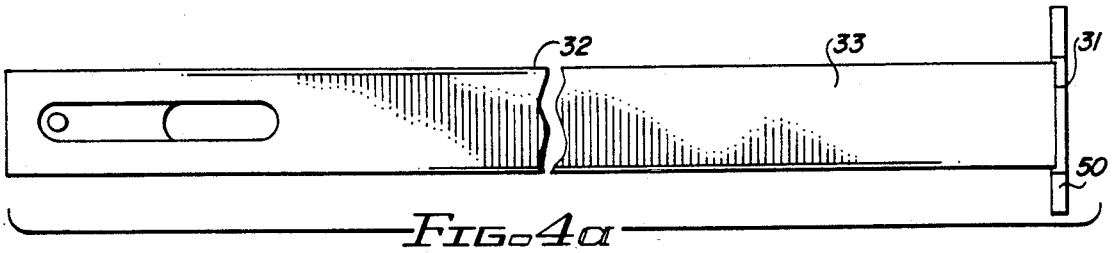
FIG. 4a
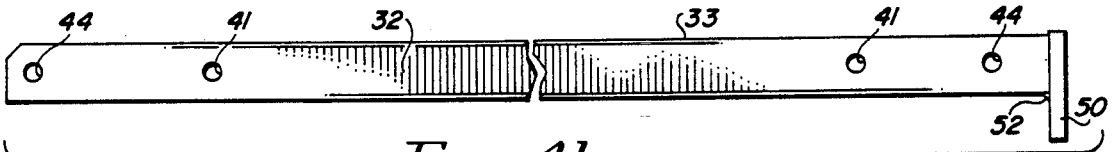
FIG. 4b
FIG. 6
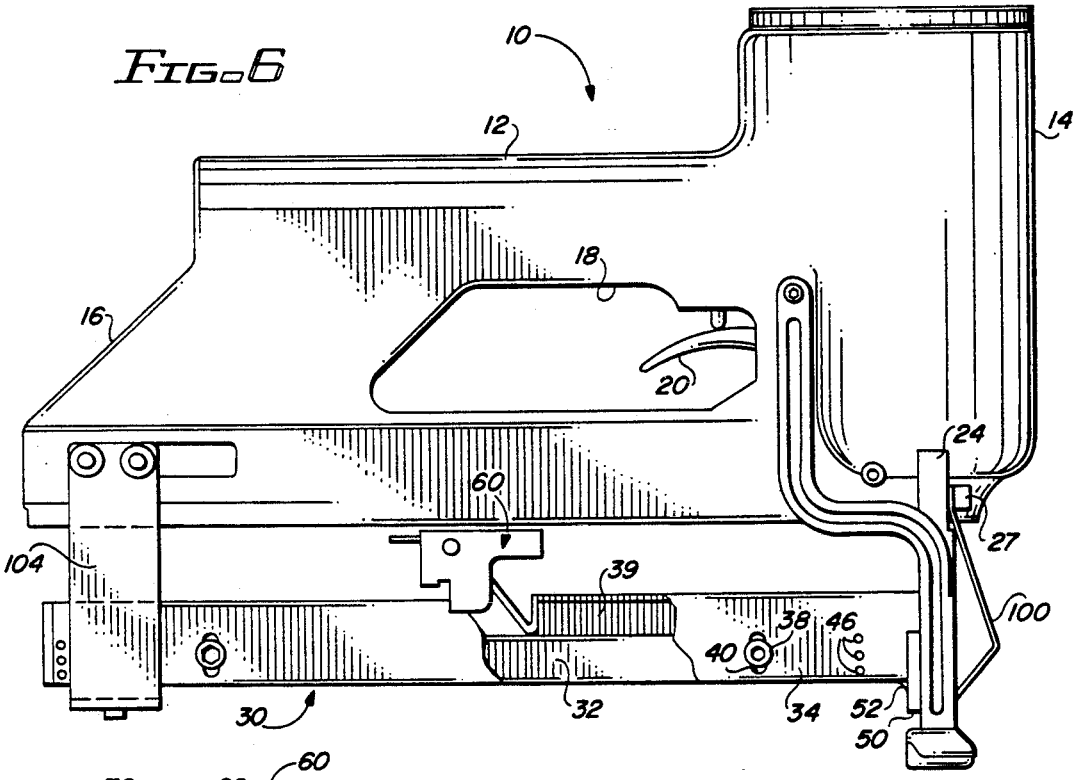
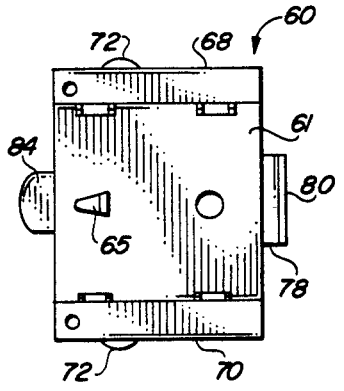
FIG. 5a
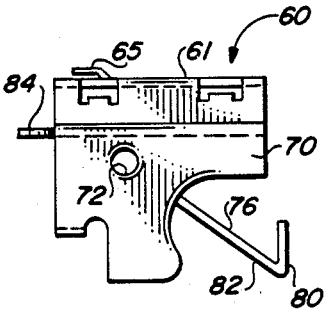
FIG. 5b
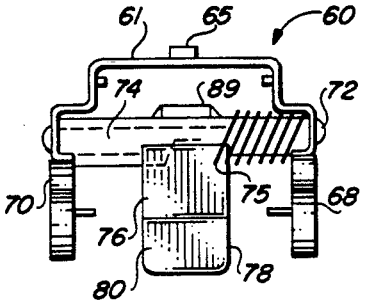
FIG. 5c

PORTABLE PNEUMATIC TOOL EMPLOYING IMPROVED MAGAZINE FEED, EJECT AND JAM-CLEARING TECHNIQUE

BACKGROUND OF THE INVENTION

The present invention relates to tools for inserting fastening devices into a work piece, and more particularly to a pneumatic apparatus for feeding corrugated fastener, staples, nails, tacks, brads or other types of fasteners into a work piece utilizing improved magazine feed, eject and jam-clearing techniques.

Portable tools having a pneumatic drive for fasteners are well known in the art; see, for example, U.S. Pat. No. 2,983,922 to Juilfs, and corresponding Re. U.S. Pat. No. 26,262. These prior art pneumatic tools are referred to generically as pneumatic corrugators or "staplers", and are characterized by a pneumatic member having a guide body extending laterally from the pneumatic member at a forward end and including a driver extending from the pneumatic member through a driver channel in the guide body. Typically, a fastener magazine is fixed underneath the pneumatic member with an open feed end extending into the guide body, with a tensioning mechanism along the fastener magazine for feeding corrugated fasteners, staples, nails, brads, tacks or other types of fasteners for which the tool is specifically adapted across a fastener loading surface of the magazine, across the open feed end and into the driver channel. Operation of the pneumatic member causes the driver to rapidly shear away the forwardmost fastener and force it through the driver channel and into the work piece. See the aforementioned U.S. Pat. No. 2,983,922 to Juilfs at FIGS. 1, 2 and 3. A typical magazine construction for such pneumatic fasteners is also taught by Juilfs in U.S. Pat. No. 3,174,672.

From time to time, these pneumatic tools are subjected to jams occurring in the drive channel. Accordingly, it is known to construct the guide body with a front plate which is pivoted to the guide body and is coupled with a recessed spring, ball detent or similar quick release mechanism for purposes of permitting the front plate to quickly move away from the driver channel when a jam occurs. A typical construction for a pivotal front plate is disclosed by Juilfs et al in U.S. Pat. 3,273,777.

The internal functioning of the pneumatic member portion of a typical prior art pneumatic tool is disclosed by Juilfs et al at U.S. Pat. No. 3,170,487.

SUMMARY OF THE INVENTION

The present invention is directed to improved magazine feed, eject and jam-clearing techniques useful with prior art pneumatic tools of the type described above.

In accordance with the present invention, an improved pneumatic tool is provided with a number of improvements which either together or alone substantially improve the efficiency, cost of manufacture, operation and reliability. These features include the use of a removable sacrificial anvil which is fixed within a recess of the forward, open feed end of the magazine and is supported by a back plate which in turn is fixed to the magazine, the anvil having an outside surface generally flush with the periphery of the drive channel.

The improved pneumatic tool according to the present invention further includes first and second magazine sides extending along a respective side of the magazine body, each side including a portion extending inwardly toward the other side and being provided with means for adjusting the dimension between the magazine body and the inwardly-extending portions so that the magazine can accept staples of different sizes. In order to identify the desired positions of the adjustable magazine sides, the tool is provided with detent means for identifying plural predetermined dimensions between the magazine body and the inwardly-extending portions, each predetermined dimension corresponding to a different fastener size.

The preferred arrangement of the pneumatic tool of the present invention is further provided with improved means for feeding fasteners along the fastener loading surface of the magazine, and includes a feeder shoe positioned adjacent the fastener magazine and slidably attached to the underside of the pneumatic member so as to be slidable back and forth over the fastener loading surface. The feeder shoe includes a finger pivotably attached at a proximal end thereto, the finger having a distal end extending toward the fastener loading surface in an angular direction toward the open feed end of the magazine. Spring tensioning means are provided for urging the distal end of the finger toward the fastener loading surface, the distal end of the finger having a cam surface facing away from the open feed end, such that the distal end cams away from the fastener loading surface and across fasteners loaded thereon when the feeder shoe is slidably moved rearwardly away from the open feed end of the magazine.

The pneumatic tool of the present invention also employs a pivotal front plate for clearing jams, as described above with reference to the prior art and which is, for example, attached to the guide body with a quick release ball detent arrangement. In accordance with the present invention, the fastener is provided with a spring tensioning means across the front plate for urging the plate toward the driver channel to thereby avoid any safety hazards for flying fasteners, nails or the like which are ejected outwardly when the front plate is released during a jam.

Other improvements of the pneumatic tool of the present invention include the removable attachment of the magazine to the pneumatic member and the particular construction of the magazine body for achieving weight reduction.

Pneumatic fasteners employing the various improvements discussed above achieve a number of significant advantages with respect to prior art pneumatic fasteners. First, the sacrificial anvil construction of the present invention significantly reduces the cost of repairing or replacing parts which are subjected to high wear conditions. Second, the adjustable magazine side construction of the present invention permits the fastener to be easily adjusted for fasteners of different sizes, and to further permit the sides to be easily replaced when worn. Third, the feeder shoe arrangement of the present invention is adapted for use with the adjustable sides, and permits the facile movement of the feeder shoe rearwardly over the fasteners and then to tension the fasteners forwardly into the driver channel. Fourth, the spring tensioning feature associated with the pivotal front plate achieves significant safety improvements with respect to possible injuries occurring from fasteners, staples, nails or the like being ejected from the fastener during a jam. Fifth, the manner in which the magazine is constructed and fastened to the pneumatic member reduces costs, weight, and permits the facile replacement of the entire magazine when required.

DESCRIPTION OF THE DRAWINGS

FIG. 1 is a side elevation, partially in cross section, illustrating a pneumatic tool employing the improvements of the present invention. In FIG. 1, the feeder shoe is shown in two positions, one of which is in dotted lines to illustrate the manner in which the feeder shoe is moved across the fasteners during loading.

FIG. 2 is a front elevation of the pneumatic tool of FIG. 1, with the front plate removed in order to illustrate the sacrificial anvil, adjustable side rails and the feeder shoe improvements of the present invention.

FIGS. 4A, 4B and 4C are, respectively, top plan, side elevation and right end views of a magazine body useful in a pneumatic tool of the present invention.

FIGS. 5A, 5B and 5C are, respectively, top plan, side elevation and front elevation of the feeder shoe improvement of the present invention.

FIG. 6 is a side elevation of the pneumatic tool similar to that of FIG. 1, with the front plate and spring mechanism in place (these features being omitted in FIG. 1).

FIG. 7 is a front elevation like FIG. 2, with the front plate and spring tensioning means in place (these features being omitted in FIG. 2).

DETAILED DESCRIPTION

Figure 3:
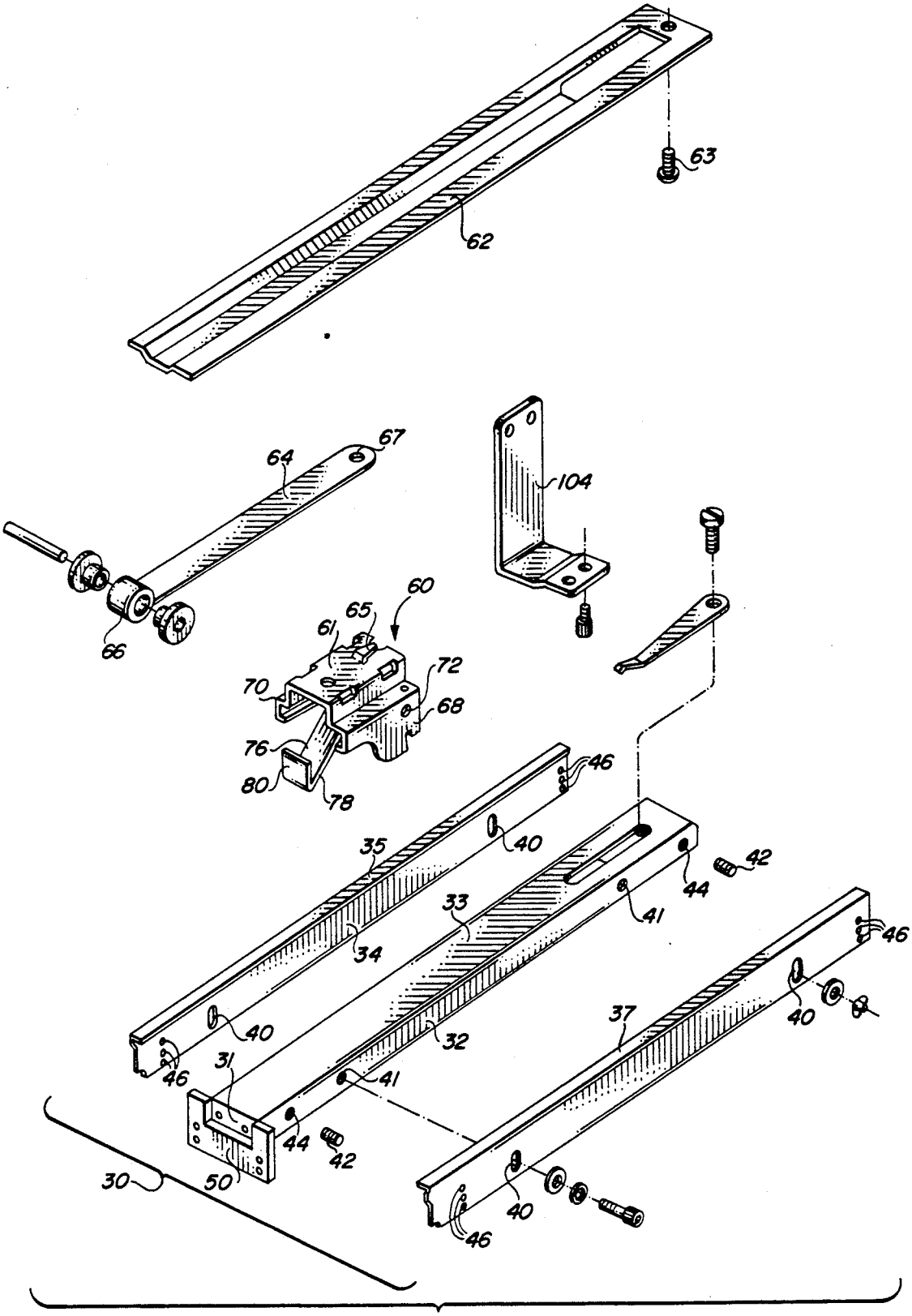
FIG. 3 is an exploded perspective view of the construction of the magazine, feed shoe and mounting bracket features of the present invention.

Preferred embodiments of the improvements in a pneumatic tool in accordance with the present invention will now be described with reference to the drawings.

Throughout the various drawing figures, the pneumatic tool is referred to generally by the reference numeral 10 and the improved magazine construction is referred to generally with the reference numeral 30. The pneumatic functioning of the tool 10 does not constitute a portion of the present invention; therefore, the pneumatic member is simply referred to generally in the various figures with the reference numeral 12, and with the front and rear ends of the pneumatic member being identified with the reference numerals 14 and 16, respectively. Typically, the pneumatic tool includes a recess 18 into which the trigger mechanism 20 extends. As is well known, the pneumatic member 12 includes a pneumatic cylinder in the forward end 14, in which pneumatic pressure is developed against a piston rod (not shown) to operate a fastener driver 26 through a guide body 24. The guide body 24 is attached to the pneumatic member 12 with fasteners 27. Again, the portions of the pneumatic tool 10 just described are well known in the prior art.

Reference is now made to FIGS. 1, 2, 3 and 4A–4C. The fastener magazine 30 includes a magazine body 32 having a forward end 31 extending into the driver channel 25 of the guide body 24 and a fastener loading surface 33. Opposing magazine side rails 34 and 36 are adjustably fastened to the respective sides of the magazine body 32 via slots 40 and fasteners 38, the fasteners 38 extending through the slots 40 into threaded openings 41 in the magazine body 32. Each adjustable side rail 34, 36 includes an inwardly-extending upper portion 35, 37, respectively, which is positioned above the fastener loading surface 33 a distance determined by an adjustable feature described below, and which is determined by the size of the fasteners 39 inserted across the fastener loading surface 33.

The degree of adjustment of the magazine side rails 34 and 36 is predetermined for dimensions between the fastener loading surface 33 and the inwardly-extending portions 35, 37 dependent upon the desired fastener size. To this end, the side rails 34, 36 are provided with small vertical openings 46 at either end, which are adapted to be engaged by a ball detent mechanism 42 which threads into openings 44 in the sides of the magazine body 32. It will of course be appreciated that each opening 46 represents a different dimension between the inwardly-extending portions 35, 37 and the fastener loading surface 33 and corresponds to a different fastener size.

Referring now to the forward end 31 of the magazine body 32, a back plate 50 is fixed via a weld 52 underneath the forward feed end 31 of the magazine body 32. A sacrificial anvil 54 is removably fastened to the forward end 31, and laps over both the back plate 50 and the lower portion 48 of the guide body 24. As shown in FIGS. 2 and 4C, the sacrificial anvil 54 is removably adjoined to the forward end 31 of the magazine body 32 via fasteners 56 extending into threaded openings 58 in the open end 31.

Reference is now made to FIGS. 1, 2, 3 and 5A–5C, which illustrate the details of the feeder shoe improvement of the present invention.

The feeder shoe, referred to generally by the reference numeral 60, is attached to the underside of the pneumatic member 12 via a plate 62 and fastener 63. The feeder shoe 60 is urged toward the forward, feed end 31 of the staple magazine 30 via a spring 64 attached at 66 to the pneumatic member and to the feeder shoe via a tab 65 and opening 67. The particular manner in which the feeder shoe 60 is attached to the underside of the pneumatic member 12 and the particular features of the spring tensioning means do not form a part of this invention, and prior art arrangements of these features are taught in the above-identified Juilfs' patents, including U.S. Pat. No. 3,174,672.

The feeder shoe 60 includes a top plate 61 and opposing side plates 68, 70 which extend downwardly toward the fastener loading surface 33. A pivot rod 72 extends between the two side plates 68, 70 and holds a cylinder 74, which is biased with a spring 75 so as to tend to rotate an attached feeder shoe finger 76 downwardly toward the fastener loading surface 33. A feeder shoe 78 is attached at the distal extremity of the finger 76, and includes a flat forward surface 80 for urging fasteners toward the forward end 31 of the magazine body 32. A finger tab 84 is fixed to the cylinder 74, to permit the manual rotation of the finger 76.

Noting FIG. 1, fasteners may be loaded from the rear end of the magazine 30, along the fastener loading surface 33 and underneath the feeder shoe 60. Because the finger 76 of the shoe 60 is pivotal about the rod 72, and because of the cam surface 82 underneath the cylinder 78, the fasteners will slide easily underneath the feeder shoe 60. Thereafter, the feeder shoe 60 may be manually returned rearwardly against the tension of spring 64, until the finger cylinder 78 drops downwardly across the back of the row of fasteners and against surface 33.

Figure 8:
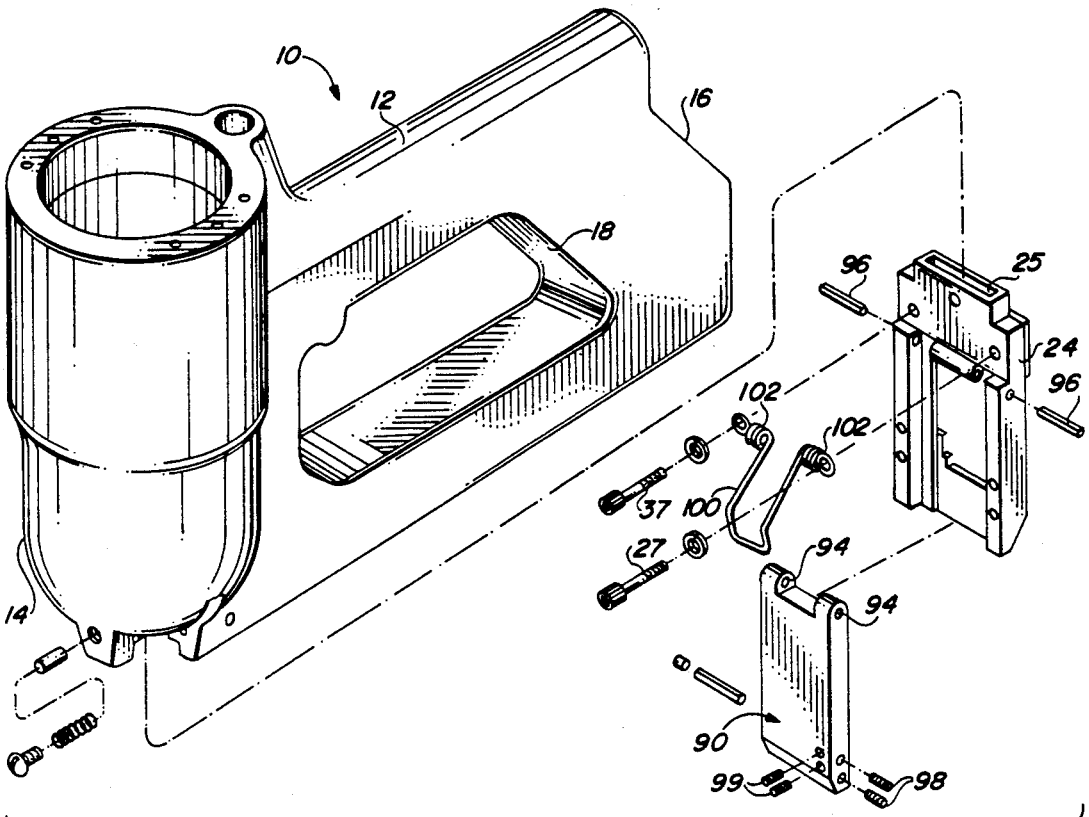
FIG. 8 is an exploded perspective view of a portion of the pneumatic tool of the present invention, illustrating the front plate and spring tensioning features.

Referring now to FIGS. 6, 7 and 8, the front plate is referred to generally by the reference numeral 90 and is pivotably fastened at its upper end through pivot holes 94 and pivot rods 96 to the guide body 24. Conventional ball detent quick release fasteners 98 are threaded into corresponding holes in the bottom of the front plate 90, and are held in place by swaged fasteners.

In accordance with this invention, there is provided a U-shaped spring 100 having tensioning coils 102 at its upper extremities, and which are attached to the front plate-guide body assembly via fasteners 27. The U-shaped spring 100 functions as a safety stop when the front plate 90 is released from the guide body at the ball detent fasteners 98 when a jam occurs, the spring urging the plate toward the guide body, to keep any fasteners emitted from the guide body during the jam from spraying outwardly, thereby avoiding any danger to nearby workers. Referring again to FIGS. 1 and 3, the entire magazine 30 may be removed from the pneumatic tool 10 in a facile manner by employing an L-shaped bracket 104 which is attached to the fastener magazine 30 and the rearward end 16 of the tool 10 via fasteners.

Figure 9A:
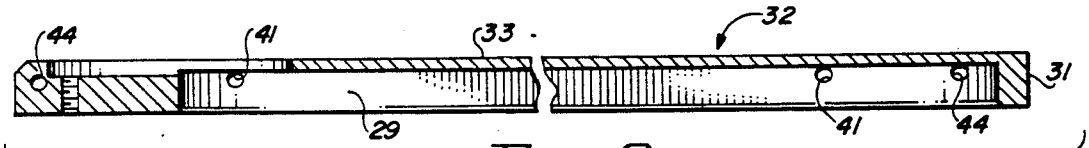
FIGS. 9(*a*), 9(*b*) and 9(*c*) are a cross-sectional side view, a top plan view and a side view, respectively, of a magazine body useful with this invention.
Figure 9B:
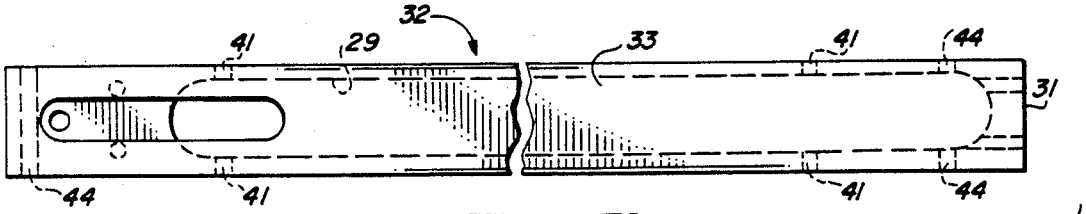
Figure 9C:
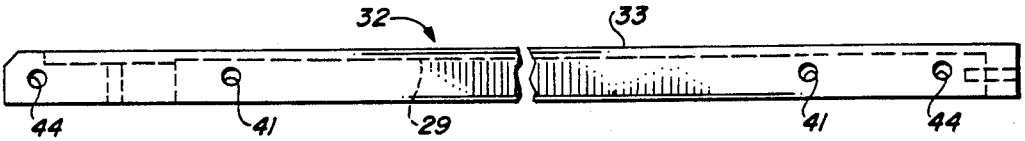

The magazine body 32 may be fabricated from light weight aluminum or alternatively from steel. When fabricated from steel, as shown in FIGS. 9A–9C, the magazine body 32 may be fitted with a machined recess 29 into which the threaded openings 41 and 44 extend. The machined opening 29 renders the magazine body 32 relatively light in weight but with the magazine body having sufficient structural strength at the forward end 31 to support the anvil 54 by virtue of back plate 50 attached thereto.

It will be appreciated by those skilled in the art that various modifications may be made in the improvements discussed above, without departing from the spirit and scope of the present invention as defined by the following claims.

What is claimed is:

1. A pneumatic tool comprising:

a pneumatic member having a forward end and a rearward end with a guide body extending laterally from the pneumatic member at the forward end, the pneumatic member further including a fastener driver extending from the pneumatic member through a driver channel in the guide body;

a fastener magazine fixed with the pneumatic member, the magazine having an open feed end extending into the guide body, the feed end of the magazine having a recess at its extremity, a back-plate fixed to the magazine under the recess, and a removable sacrificial anvil fastened in the recess and supported by the back-plate, the anvil having an outside surface generally flush with the periphery of the driver channel;

means for developing pneumatic pressure within the pneumatic member to sequentially actuate the driver into and out of the driver channel and along the outside anvil surface in order to drive fasteners loaded in the magazine out of the guide body; and means for urging fasteners across a fastener loading surface in the magazine, toward the feed end and across the anvil.

2. The pneumatic tool recited in claim 1 wherein the fastener magazine includes a magazine body, first and second magazine sides extending along a respective side of the magazine body, each side including a portion extending inwardly toward the other side; and means for adjusting the dimension between the magazine body and the inwardly-extending portions of the first and second sides so that the magazine can accept fasteners of different sizes.

3. The pneumatic tool recited in claim 2 further comprising detent means with the fastener magazine for identifying plural predetermined dimensions between the magazine body and the inwardly-extending portions, each predetermined dimension corresponding to a different fastener size.

4. The pneumatic tool recited in claim 2 further comprising means for removably attaching the first and second magazine sides to the respective sides of the magazine body.

5. The pneumatic tool recited in claim 2 wherein the first and second magazine sides extend through the recess and terminate adjacent the sacrificial anvil.

6. The pneumatic tool recited in claim 2 wherein the magazine body comprises a unitary metal body having a longitudinal slot extending along a surface opposite the fastener surface.

7. The pneumatic tool recited in claim 6 further comprising detent means including plural threaded members extending through the magazine body and into the longitudinal slot, the detent means engaging corresponding holes in the first and second sides to permit identification of predetermined dimensions between the magazine body and the inwardly-extending portions, each predetermined dimension corresponding to a different staple size.

8. The pneumatic tool recited in claim 7 further comprising threaded fasteners extending through the first and second sides, the magazine body and into the longitudinal slot.

9. The pneumatic tool recited in claim 1 further comprising a removable fastener extending through the sacrificial anvil and into the feed end of the magazine.

10. The pneumatic stapler recited in claim 9 wherein the sacrificial anvil comprises a tapped hole for receiving the removable fastener.

11. The pneumatic tool recited in claim 9 wherein the sacrificial anvil comprises a flat surface lying flush with and in the plane of the fastener loading surface, and a shear corner at the intersection of the flat anvil surface and the outside anvil surface.

12. The pneumatic tool recited in claim 1 wherein the staple urging means comprises:

a feeder shoe positioned adjacent the fastener magazine and slidably attached to the pneumatic member so as to be slidable back and forth over the fastener loading surface;

a feeder shoe finger pivotably attached at a proximal end to the feeder shoe, the finger having a distal end extending toward the fastener loading surface in an angular direction toward the open feed end of the magazine;

spring tensioning means for urging the distal end of the finger toward the fastener loading surface; and wherein the distal end of the finger has a cam surface facing away from the open feed end, so that the distal end cams away from the fastener loading surface and across the fasteners located thereon, when the feeder shoe is slidably moved rearwardly away from the open feed end of the magazine.

13. The pneumatic tool recited in claim 12 wherein the distal finger end includes a pressure surface facing toward the open end and extending generally parallel with fasteners on the fastener loading surface.

14. The pneumatic tool recited in claim 1 further comprising a front plate extending along a side of the drive channel opposite the anvil, the front plate movable between closed and open positions responsive to a fastener jam within the channel, and spring tensioning means for urging the front plate toward the driver channel.

15. The pneumatic tool recited in claim 1 further comprising means for removably attaching the magazine to the pneumatic member.

16. A pneumatic tool comprising:

a pneumatic member having a forward end and a rearward end with a guide body extending laterally from the pneumatic member at the forward end, the pneumatic member further including a fastener driver extending from the pneumatic member through a driver channel in the guide body;

a fastener magazine including a magazine body fixed with the pneumatic member, the magazine having an open feed end extending into the guide body, the feed end of the magazine having a recess at its extremity, a back-plate fixed to the magazine under the recess, and a removable sacrificial anvil fastened in the recess and supported by the back-plate, the anvil having an outside surface generally flush with the periphery of the driver channel;

first and second magazine sides each extending along a respective side of the magazine body, each side including a portion extending inwardly toward the other side;

means for adjusting the dimension between the magazine body and the inwardly extending portions of the first and second sides so that the magazine can accept fasteners of different sizes;

means for developing pneumatic pressure within the pneumatic member to sequentially actuate the driver into and out of the driver channel in order to drive fasteners loaded in the magazine out of the guide body and along the outside anvil surface; and means for urging fasteners across a fastener loading surface in the magazine and toward the feed end of the magazine and across the anvil.

17. The pneumatic tool recited in claim 16 further comprising detent means within the fastener magazine for identifying plural predetermined dimensions between the magazine body and the inwardly-extending portions, each predetermined dimension corresponding to a different fastener size.

18. The pneumatic tool recited in claim 16 further comprising means for removably attaching the first and second magazine sides to the respective sides of the magazine body.

19. The pneumatic tool recited in claim 16 wherein the fastener urging means comprises:

a feeder shoe positioned adjacent the fastener magazine and slidably attached to the pneumatic member so as to be slidable back and forth over the fastener loading surface;

a feeder shoe finger pivotably attached at a proximal end to the feeder shoe, the finger having a distal end opposite the proximal end extending toward the fastener loading surface in an angular direction toward the open feed end;

spring tensioning means for urging the distal end of the finger toward the fastener loading surface and wherein the distal end of the finger has a cam surface facing away from the open feed end so that the distal end cams away from the fastener loading surface and across the fasteners located thereon when the feeder shoe is slidably moved rearwardly away from the open feed end.

20. The pneumatic tool recited in claim 16 further comprising a front plate extending along a side of the driver channel opposite the anvil, the front plate movable between closed and open positions responsive to a fastener jam within the channel, and spring tensioning means for urging the front plate toward the driver channel.

21. A pneumatic tool comprising:

a pneumatic member having a forward end and a rearward end with a guide body extending laterally from the pneumatic member at the forward end, the pneumatic member further including a fastener driver extending from the pneumatic member through a driver channel in the guide body;

a fastener magazine fixed with the pneumatic member, the magazine having a fastener loading surface and an open feed end extending into the guide body, the feed end of the magazine having a recess at its extremity, a back-plate fixed to the magazine under the recess, and a removable sacrificial anvil fastened in the recess and supported by the back-plate, the anvil having an outside surface generally flush with the periphery of the driver channel;

a feeder show positioned adjacent the fastener magazine and slidably attached to the pneumatic member so as to be slidable back and forth over the fastener loading surface;

a feeder shoe finger pivotably attached at a proximal end to the feeder shoe, the finger having a distal end extending toward the fastener loading surface in an angular direction toward the open feed end;

spring tensioning means for urging the distal end of the finger toward the fastener loading surface;

the distal end of the finger having a cam surface facing away from the open feed end, so that the distal end cams away from the fastener loading surface and across the fasteners located thereon when the feeder shoe is slidably moved rearwardly away from the open feed end;

means for developing pneumatic pressure within the pneumatic member to sequentially actuate the driver into and out of the driver channel in order to drive fasteners loaded in the magazine out of the guide body and along the outside anvil surface; and means for urging fasteners across the fastener loading surface in the magazine and toward the feed end and across the anvil.

22. The pneumatic tool recited in claim 21 wherein the distal finger end includes a pressure surface facing toward the open end and extending generally parallel with fasteners on the fastener loading surface when the distal end is against that surface.

23. The pneumatic tool recited in claim 22 further comprising the feed end of the magazine having a recess at its extremity, a back plate fixed to the magazine under the recess, and a removable sacrificial anvil fastened in the recess and supported by the back plate, the anvil having an outside surface generally flush with the periphery of the driver channel.

24. The pneumatic tool recited in claim 21 further comprising a front plate extending along a side of the driver channel opposite the anvil, the front plate movable between closed and open positions responsive to a fastener jam within the channel, and spring tensioning means for urging the front plate toward the driver channel.

25. The pneumatic tool recited in claim 21 further comprising means for removably attaching the magazine to the pneumatic member.

26. The pneumatic tool recited in claim 21 wherein the magazine includes a magazine body and first and second magazine sides extending along a respective side of the magazine body, each side including a portion extending inwardly toward the other side; and means for adjusting the magazine body and the inwardly-extending portions of the first and second sides, so that the magazine can accept fasteners of different sizes.

27. A pneumatic tool comprising:

a pneumatic member having a forward end and a rearward end with a guide body extending laterally from the pneumatic member at the forward end, the pneumatic member further including a fastener drive extending from the pneumatic member through a driver channel in the guide body;

a fastener magazine fixed with the pneumatic member, the magazine having a fastener loading surface and an open feed end extending into the guide body, the feed end of the magazine having a recess at its extremity, a back-plate fixed to the magazine under the recess, and a removable sacrificial anvil fastened in the recess and supported by the pack plate, the anvil having an outside surface generally flush with the periphery of the driver channel;

a front plate extending along a side of the driver channel opposite the feed end of the magazine;

means for releasing the front plate from a closed position to an open position responsive to a fastener jam within the channel;

spring tensioning means for urging the front plate toward the driver channel during release to the open position responsive to a fastener jam;

means for developing pneumatic pressure within the pneumatic member to sequentially actuate the driver into and out of the driver channel in order to drive fasteners loaded in the magazine out of the guide body; and means for urging fasteners along the fastener loading surface and toward the feed end.

28. The pneumatic tool recited in claim 27 wherein the fastener magazine includes a magazine body, first and second magazine sides extending along a respective side of the magazine body, each side including a portion extending inwardly toward the other side; and means for adjusting the dimension between the magazine body and the inwardly-extending portions of the first and second sides so that the magazine can accept fasteners of different sizes.

* * * * *